US010965006B2

(12) United States Patent
Xiong et al.

(10) Patent No.: US 10,965,006 B2
(45) Date of Patent: Mar. 30, 2021

(54) TERMINAL BACK COVER AND MOBILE TERMINAL

(71) Applicant: Beijing Xiaomi Mobile Software Co., Ltd., Beijing (CN)

(72) Inventors: Xiaofeng Xiong, Beijing (CN); Linchuan Wang, Beijing (CN); Zonglin Xue, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 695 days.

(21) Appl. No.: 15/454,849

(22) Filed: Mar. 9, 2017

(65) Prior Publication Data

US 2017/0264004 A1 Sep. 14, 2017

(30) Foreign Application Priority Data

Mar. 11, 2016 (CN) ..... 201610141670.4

(51) Int. Cl.
*H01Q 1/24* (2006.01)
*H01Q 13/10* (2006.01)
(Continued)

(52) U.S. Cl.
CPC ..... *H01Q 1/243* (2013.01); *H01Q 1/38* (2013.01); *H01Q 1/48* (2013.01); *H01Q 1/521* (2013.01); *H01Q 7/00* (2013.01); *H01Q 13/106* (2013.01)

(58) Field of Classification Search
CPC ..... H01Q 1/243–245; H01Q 13/106
See application file for complete search history.

(56) References Cited

U.S. PATENT DOCUMENTS 8,489,162 B1 7/2013 Dou et al.
9,997,833 B2 * 6/2018 Lee ..... H01Q 1/243
(Continued)

FOREIGN PATENT DOCUMENTS

CN 103633426 A 3/2014
CN 103682570 A 3/2014
(Continued)

OTHER PUBLICATIONS

Extended European search report issued in corresponding European Application No. 17157224.1, dated Jul. 25, 2017, 9 pages.
(Continued)

*Primary Examiner* — Graham P Smith
*Assistant Examiner* — Amal Patel
(74) *Attorney, Agent, or Firm* — Arch & Lake LLP

(57) ABSTRACT

A back cover includes: a back cover body, an antenna structure, a first hand-held part, and a second hand-held part arranged apart from the first hand-held part. The antenna structure includes a first part whose first side is separated from one end of the back cover body by a first slit, a second part separated from a second side of the first part by a second slit, and a third part for connecting the first and second parts. The first hand-held part extends to the second part from the back cover body and separated from a third side of the first part by a third slit. The second hand-held part extends to the second part from the back cover body and separated from a fourth side of the first part by a fourth slit, where the back cover body and the antenna structure are made of a metal material.

20 Claims, 5 Drawing Sheets

(51) Int. Cl.

| | |
|---|---|
| ***H01Q 1/38*** | (2006.01) |
| ***H01Q 1/48*** | (2006.01) |
| ***H01Q 1/52*** | (2006.01) |
| ***H01Q 7/00*** | (2006.01) |

(56) References Cited

U.S. PATENT DOCUMENTS

| | | | | |
|---|---|---|---|---|
| 2008/0106478 | A1 | 5/2008 | Hill | |
| 2013/0207846 | A1 | 8/2013 | Chiu et al. | |
| 2016/0056527 | A1 | 2/2016 | Pascolini et al. | |
| 2016/0285153 | A1 | 9/2016 | Li et al. | |
| 2016/0285520 | A1* | 9/2016 | Baek | H01Q 13/10 |
| 2017/0125889 | A1 | 5/2017 | Pascolini et al. | |

FOREIGN PATENT DOCUMENTS

| | | | | |
|---|---|---|---|---|
| CN | 203466292 | U | 3/2014 | |
| CN | 204538197 | U | 8/2015 | |
| CN | 105605065 | A | 2/2016 | |
| CN | 105552516 | A | 5/2016 | |
| CN | 105680152 | A | 6/2016 | |
| CN | 105846054 | A | 8/2016 | |
| WO | 2008/063269 | A1 | 5/2008 | |
| WO | WO-2015088214 | A1 * | 6/2015 | H01Q 9/14 |

OTHER PUBLICATIONS

First Office Action issued in corresponding Chinese Application No. 201610141670.4 dated Dec. 5, 2017, 7 pages.

International Search Report issued in corresponding PCT Application No. PCT/CN2016/101299, dated Dec. 23, 2016, 14 pages.

* cited by examiner

TERMINAL BACK COVER AND MOBILE TERMINAL

CROSS-REFERENCE TO RELATED APPLICATION

This application is based on and claims priority of the Chinese Patent Application No. 201610141670.4, filed on Mar. 11, 2016, which is incorporated herein by reference in its entirety.

TECHNICAL FIELD

The present disclosure is related to the field of antenna design technology, and more particularly to a terminal back cover and a mobile terminal including the terminal back cover.

BACKGROUND

Current handsets with bodies made of metal become more and more popular due to their fashionable appearance, and therefore mainstream handset manufacturers have all launched metal handsets. Compared with plastic bodies, metal bodies possess unique glossy texture and cool and fine handfeel, such that the handsets look far more high-end. In addition, as frames of the existing handsets tend to be narrower, requirements on the frames are increasingly high. Moreover, owing to better heat conductivity of metal, overheat of the handsets will not occur even after they are operated for a long time, thereby prolonging the service life of the handsets. Therefore, metal having high strength and hardness is preferred to be used to make bodies of the handsets.

At present, the difficulty in designing the handset having a metal housing lies I n its antenna. For a common antenna, the metal housing may shield radiation of the antenna, thus resulting in no signal or call drop of the handset.

Therefore, there is a need for a new terminal back cover and a mobile terminal including the same.

The above-mentioned information disclosed in the background portion is only intended for strengthening the understanding to the background of this disclosure, and thus may include information which may not constitute the prior arts known by a person having ordinary skill in the art.

SUMMARY

The present disclosure provides a terminal back cover and a mobile terminal using the same, which solve the problem that hand-holding of a metal handset affects an antenna signal when the metal handset is used for achieving its industrial effect.

Other features and advantages of this disclosure will become apparent from the following detailed description, or may be learnt from practice of this disclosure.

According to an aspect of the present disclosure, there is provided a terminal back cover that includes: a back cover body, an antenna structure, a first hand-held part and a second hand-held part arranged apart from the first hand-held part. The antenna structure including a first part whose first side is separated from one end of the back cover body by a first slit, a second part separated from a second side of the first part by a second slit, and a third part for connecting the first and second parts. The first hand-held part extends to the second part of the antenna structure from the back cover body and separated from a third side of the first part of the antenna structure by a third slit. The second hand-held part extends to the second part of the antenna structure from the back cover body and separated from a fourth side of the first part of the antenna structure by a fourth slit, where the back cover body and the antenna structure are made of a metal material.

According to another aspect of the embodiments of this disclosure, there is provided a mobile terminal, including: a terminal back cover according to any of the above embodiments; and a circuit board including an antenna feed point and a loop grounding point.

According to an embodiment of this disclosure, the mobile terminal further includes a first electrically conductive connector and a second electrically conductive connector, the first electrically conductive connector being configured to electrically connect the antenna feed point and the first electrical contact part of the terminal back cover, the second electrically conductive connector being configured to electrically connect the loop grounding point and the second electrical contact part of the terminal back cover.

According to an embodiment of this disclosure, the first and second electrically conductive connectors each include at least one of a resilient gasket, a screw, a lumped element and electrically conductive foam.

According to an embodiment of this disclosure, the mobile terminal further includes a radio frequency element, wherein the antenna feed point is arranged on the radio frequency element, and a wireless signal sent from the radio frequency element is coupled to the terminal back cover from the antenna feed point through the first electrically conductive connectors and is then sent out.

The terminal back cover and the mobile terminal of this disclosure can effectively reduce the influence by hand-holding of an all-metal handset to its antenna while the all-metal handset is used for achieving its industrial effect.

It should be understood that both the foregoing general description and the following detailed description are exemplary and explanatory only and are not restrictive of the disclosure.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure.

DETAILED DESCRIPTION

Figure 1:
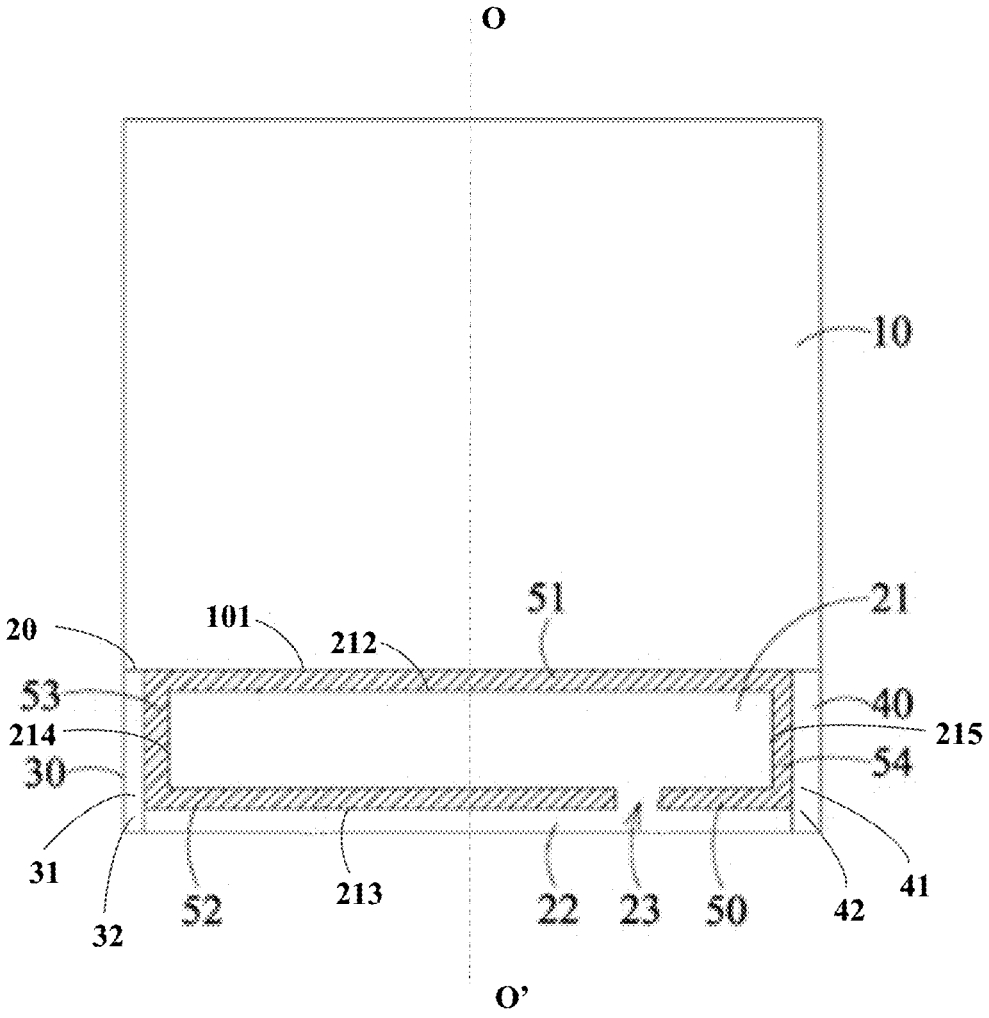
FIG. 1 is a schematic structural diagram of a terminal back cover according to one or more embodiments of this disclosure.

Now, exemplary embodiments will be fully described with reference to the drawings. However, the exemplary embodiments may be implemented in various forms, and shall not be construed as being limited to the examples described herein. Instead, the embodiments will make this disclosure comprehensive and complete, and will fully convey the concept of the embodiments to those skilled in the art. The drawings are only schematic ones of this disclosure, and may not be necessarily drawn to scale. The same reference signs in the drawings represent the same or similar parts, so repeated descriptions thereof will be omitted.

In addition, the features, structures or properties described herein may be combined in one or more embodiments in any suitable manner. In the following description, many details are provided to offer full understanding of the embodiments of this disclosure. However, those skilled in the art shall appreciate that the technical solutions of this disclosure may be practiced while omitting one or more of the specific details or introducing other elements, apparatus or steps. In other cases, well-known structures, apparatuses, implementations, materials or operations will not be shown or described so as not to obscure aspects of this disclosure.

Some block diagrams in the drawings show functional entities, but they may not necessarily correspond to physically or logically independent functional entities. These functional entities may be implemented by software, or implemented in one or more hardware modules or integrated circuits or among different networks and/or processor devices and/or microprocessor devices.

The implementations set forth in the following description of embodiments do not represent all implementations consistent with this disclosure. Instead, they are only examples consistent with some aspects of this disclosure as set forth in the appended claims.

FIG. 1 is a schematic structural diagram of a terminal back cover according to one or more embodiment of this disclosure.

As shown in FIG. 1, the terminal back cover includes: a back cover body 10; an antenna structure 20, a first hand-held part 30, and a second hand-held part 40. The antenna structure 20 includes a first part 21 whose first side 212 is separated from one end 101 of the back cover body 10 by a first slit 51, a second part 22 separated from a second side 213 of the first part 21 by a second slit 52, and a third part 23 for connecting the first part 21 and the second part 22. The first hand-held part 30 extends to the second part 22 of the antenna structure from the back cover body 10 and separated from a third side 214 of the first part 21 of the antenna structure by a third slit 53. The second hand-held part 40 is arranged apart from the first hand-held part 30. For example, the second hand-held part 40 may be arranged symmetrically to the first hand-held part 30 relative to a center line OO' of the terminal back. In one or more embodiments, the first hand-held part 30 and the second hand-held part 40 may be arranged asymmetrically relative to the center line OO'. The second hand-held part 40 extends to the second part 22 of the antenna structure from the back cover body 10 and is separated from a fourth side 215 of the first part 21 of the antenna structure by a fourth slit 54, where the back cover body 10 and the antenna structure are made of a metal material.

In the following, detailed description will be given by taking an example in which the terminal back cover of this disclosure is applied to a handset, which is a mobile terminal. Of course, the terminal back cover of this disclosure may be applied to other mobile devices including one or more antennas, which will not be limited herein.

In an embodiment of this disclosure, the first and second sides are separated from each other, and the third and fourth sides are separated from each other.

In an embodiment of this disclosure, the first and second hand-held parts 30 and 40 are electrically isolated from the antenna structure.

In an embodiment of this disclosure, the first and second hand-held parts 30 and 40 are made of a non-metal material.

In an embodiment of this disclosure, the first and second hand-held parts 30 and 40 each include a coated layer, which may be a spray coating of a metal-like color.

The terminal back cover of this disclosure solves the problem with hand-holding of an all-metal handset, by replacing a metal material of the first and second hand-held parts at the left and right sides of the handset frame at a lower part of the back cover with a non-metal material, the first and second hand-held parts being usually held by hands. As the areas close to hands are all made of a non-metal material, influence by hands to the antenna signal can be effectively reduced. In addition, to ensure a favorable appearance, the first and second hand-held parts made of the non-metal material may be sprayed with a metal-like color.

In one or more embodiments of this disclosure, the first part 21 of the antenna structure further includes a first electrical contact part electrically connected to an external circuit, and the second part 22 of the antenna structure further includes a second electrical contact part electrically connected to the external circuit. As such, the terminal back cover is directly connected to an antenna feed point on a circuit board of a mobile terminal such as a handset.

In this disclosure, the antenna structure is operable over a frequency band ranging from 770 MHz to 2,700 MHz. The antenna structure may be operable over other frequency bands.

In this disclosure, an electric current path of the antenna structure between the first and second electrical contact parts has a length greater than or equal to one fourth of a wavelength. For example, the wavelength may corresponds to a wavelength of electromagnetic waves having a frequency component at 770 MHz. In one case, the wavelength corresponds to a wavelength of 770 MHz electromagnetic waves.

In this disclosure, the first, second, third and fourth slits 51, 52, 53 and 54 may have the same width.

In one or more embodiments of this disclosure, the width is greater than or equal to 1 mm. Usually, the wider the slit, the better; and the minimum width may be around 1 mm, which may be in the range of 0.8 mm to 1.2 mm, and preferably in the range of 0.9 mm to 1.1 mm.

Here, the width of the slit may be set according to specific circumstances. Because the performance of the antenna degrades dramatically as the width of the slit decreases, the width of the slit may be adjusted depending on circumstances such as specific performance requirements and appearance requirements. In some embodiments, the frequency offset of a high frequency band resonance is adjusted by adjusting the width of the slit.

In one or more embodiments of this disclosure, the widths of the first, second, third and fourth slits 51, 52, 53 and 54 may also be different. For example, the width of the first slit 51 is designed to be 2 mm and the width of the second slit 52 is designed to be 1 mm, for the purposes of obtaining a low frequency resonance at a lower frequency band on one hand and meeting the appearance design requirements for a handset housing on the other hand.

In one or more embodiments of this disclosure, the back cover body 10 and the antenna structure are made of the same metal material.

In an embodiment of this disclosure, the back cover body 10 and the antenna structure are made of different metal materials.

As a metal housing being conductive and having a cuboid structure, the terminal back cover of this disclosure may be used as a housing of a handset. Of course, the housing may also be made of an alloy, such as stainless steel or magnalium alloy by milling, forging and pressing, etc. The housing includes left and right surfaces, a top surface, a bottom surface and a front surface, and may also be of a polyhedral shape, which will not be limited herein. The housing may be provided with a display screen, and related components on a handset, such as a home screen key, a speaker, a camera, USB and side keys. Of course, positions of various components may be designed according to specific circumstances, and will not be limited herein.

In an embodiment of this disclosure, the first, second, third and fourth slits are filled with an insulating material, the insulating material connecting the back cover body and the first part, the first part and the second part, the first hand-held part and the first part, and the second hand-held part and the first part, respectively.

In an embodiment of this disclosure, the insulating material is bonded with the back cover body, the antenna structure, the first hand-held part and the second hand-held part using a nanometer injection molding process.

In one or more embodiments of this disclosure, the first part of the antenna structure is of a cuboid shape, and the second part thereof is of a sheet shape. The insulating material may be of an annular shape, a sheet shape, a cuboid shape, etc., and may be a high-molecular polymer, such as PC or ABS. After injection molding, the antenna structure, the first hand-held part, the second hand-held part and the back cover body are integrally formed as a housing of a handset.

In one or more embodiments of this disclosure, the antenna structure is positioned below the back cover body.

The terminal back cover provided by this disclosure is applicable to a housing made of a metal material. By adopting a non-metal material to make frames of left and right hand-held areas and by arranging the first, second, third and fourth slits, the influence by human's hands or head to the antenna is avoided, thereby not only enabling a bulk of metal to be excited to serve as an antenna but also avoiding the influence by hand-holding to the antenna and therefore enhancing the user experience.

In addition, hand-held areas made of the non-metal material may be sprayed with a metal-like color, such that the sense of beauty of a metal handset may be increased.

Meanwhile, in the case of applying antennas for single carrier transmission (in GSM mode for example) or multi-carrier parallel transmission (in LTE mode for example), it is unnecessary to arrange two or multiple sets of antennas to switch therebetween, such that the antenna structure is simplified and the cost is reduced. That is, the cost is low and the reliability is high.

Figure 2:
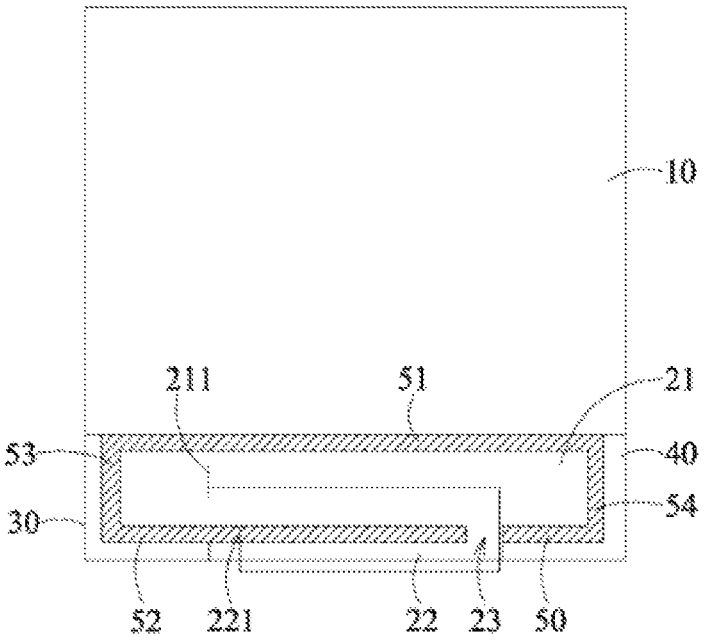
FIG. 2 is a schematic structural diagram of a terminal back cover according to one or more embodiments of this disclosure.

FIG. 2 is a schematic structural diagram of a terminal back cover according to one or more embodiments of this disclosure.

As shown in FIG. 2, the terminal back cover includes: a back cover body 10; an antenna structure, the antenna structure including a first part 21 whose first side is separated from one end of the back cover body 10 by a first slit 51, a second part 22 separated from a second side of the first part 21 by a second slit 52, and a third part 33 for connecting the first part 21 and the second part 22; a first hand-held part 30 extending to the second part 22 of the antenna structure from the back cover body 10 and separated from a third side of the first part 21 of the antenna structure by a third slit 53; and a second hand-held part 40 arranged apart from the first hand-held part 30, extending to the second part 22 of the antenna structure from the back cover body 10 and separated from a fourth side of the first part 21 of the antenna structure by a fourth slit 54, wherein the back cover body 10 and the antenna structure are made of a metal material.

In one or more embodiments, the symmetrical arrangement of the first hand-held part and the second hand-held part does not means that the shapes thereof must be identical, but is only intended to show that the first hand-held part and the second hand-held part are respectively arranged at left and right sides of the mobile terminal usually held by the user's hands.

In one or more embodiments of this disclosure, the first hand-held part 30 includes a first unit (31) and a second unit (32), the first unit (31) being separated from the third side 21-B of the first part 21 of the antenna structure by the third slit 53, and the second unit (32) being separated from the second side 21-A of the first part 21 by a part of the second slit 52.

In one or more embodiments of this disclosure, the second hand-held part 40 includes a third unit and a fourth unit (42), the third unit being separated from the fourth side 21-C of the first part 21 of the antenna structure by the fourth slit 54, and the fourth unit (42) being separated from the second side 21-A of the first part 21 by a part of the second slit 52.

In this disclosure, the first hand-held part 30 and the second hand-held part 40 may each have of a vertical angle shape or a circular arc shape.

In an embodiment of this disclosure, the first and second hand-held parts are made of a non-metal material, which may include plastic, ceramic, Sapphire, glass, or other material.

In an embodiment of this disclosure, the first and second hand-held parts each include a spray coating of a metal-like color.

The antenna structure and the first and second hand-held parts are arranged at respective sides of the back cover body. Specifically, the first and second hand-held parts are respectively arranged at two sides of the lower end of the terminal back cover. The first hand-held part is arranged at one side (for example, the left side in FIG. 2) of the antenna structure, and the first hand-held part is separated from the first part of the antenna structure by the left sides of the third slit and the second slit; and the second hand-held part is arranged at the other side (for example, the right side in FIG. 2) of the antenna structure, and the second hand-held part is separated from the first part of the antenna structure by the right sides of the fourth slit and the second slit. The first slit and the second slit each connect with the third slit and the fourth slit. The back cover body, the antenna structure, the first hand-held part and the second hand-held part are connected integrally via an insulating material.

In an embodiment of this disclosure, the first part 21 of the antenna structure further includes a first electrical contact part 211 electrically connected to an external circuit; and the second part 22 of the antenna structure further includes a second electrical contact part 221 electrically connected to the external circuit. Thus, the terminal back cover is directly connected to an antenna feed point on a circuit board of a mobile terminal such as a handset.

To reduce the adverse influence of the terminal back cover to the antenna, the antenna feed point of the external circuit may, for example, prop against the terminal back cover via a first electrically conductive connector. The first part of the antenna structure is connected to the terminal back cover via the first electrically conductive connector. That is, one end of the first electrically conductive connector is connected to the external circuit board, and the other end thereof props against the terminal back cover.

In an embodiment of this disclosure, an electric current path of the antenna structure between the first and second electrical contact parts 211, 221 has a length greater than or equal to one fourth of a wavelength.

In an embodiment of this disclosure, the antenna structure is operable over a frequency band ranging from 770 MHz to 2,700 MHz, the wavelength corresponding to a wavelength of 770 MHz electromagnetic waves. If the length is not enough, the antenna structure fails to be operable at 770 MHz.

Through the first electrical contact part 221 of the antenna structure, the electric current travels a certain path in the first part 21 of the antenna structure of the terminal back cover, and is then coupled to the second part 22 of the antenna structure at the lower end. Next, the second part 22 of the antenna structure is connected to a loop grounding point of the circuit board of the handset by the second electrically conductive connector for loop grounding. A theoretical length between the antenna feed point and the loop grounding point should be greater than or equal to one fourth of a wavelength λ, the wavelength λ being a wavelength corresponding to lowest-frequency electromagnetic waves. For example, when the antenna is operable over a frequency band ranging from 770 MHz to 2,700 MHz so as to enable GMS voice and LTE full-band coverage, the wavelength λ is the wavelength corresponding to 770 MHz electromagnetic waves. The low frequency at the antenna results from the whole length between the antenna feed point and the loop grounding point (that is, the length of the electric current path of the antenna structure between the first electrical contact part and the second electrical contact part, as shown in FIG. 2), and the high frequency results from high-order mode resonance.

The frequency offset of the whole frequency band may be adjusted by adjusting the position of the first electrical contact part. The high-frequency bandwidth may be increased dramatically at a certain position. Therefore, the position of the first electrical contact part may be adjusted according to specific performance requirements, and will not be limited herein. The third part of the antenna structure serves to connect the second part and the first part of the antenna structure, and the low-frequency impedance may be adjusted by adjusting the position of the third part. The impedance of a second high-frequency band resonance may be adjusted by adjusting the position of the second electrical contact part. Therefore, the positions of the third part and the second electrical contact part of the antenna structure may be adjusted respectively according to the specific performance requirements, and will not be limited herein.

The first electrical contact part is arranged at one end, close to the first holding part, of the first part of the antenna structure; and the second electrical contact part is arranged at one end, close to the first holding part, of the second part of the antenna structure.

The length of the electric current path of the antenna structure determines a resonance frequency point, wherein the resonance frequency point should at an operating frequency point of the handset, such as 770 MHz.

For example, the length of the electric current path of the antenna structure is one fourth of a wavelength and may be fine-tuned. That is, a resonance point of the antenna is adjusted by adjusting the length of the electric current path.

The antenna is configured to receive and transmit signals, the signals having different working frequencies corresponding to different wavelengths. Only when the length of the electric current path between the first electrical contact part and the second electric contact part of the antenna structure is equal to a corresponding wavelength (for example, 0.25 wavelength), it is said that a resonance, i.e., a first mode of the antenna (the frequency in this case is relatively low, so it is called a low-frequency mode), occurs. If N times the length of the electric current path approaches a high-frequency wavelength of the signal, it may also be said that a resonance, namely a high-frequency mode in this case (such as 1 wavelength, 1.5 wavelengths and 2 wavelengths), occurs. In this embodiment, in the case of the low-frequency mode, the length of an electric current path formed by coupling the antenna feed point to the antenna structure just approaches the desired low-frequency wavelength, and therefore resonance may occur. In the case of the high-frequency mode, due to frequency multiplication under high-order mode of the antenna, the length of this electric current path also approaches the wavelength of the high-frequency signals.

In one or more embodiments, the low-frequency operating mode of the antenna results from excitation of an open loop antenna formed by coupling the antenna feed point to the grounded antenna structure; and the high-frequency mode results from high-order mode excitation of the slits between antenna structures and the open loop antenna.

In one or more embodiments, "low frequency" refers to 770 MHz to 960 MHz, and "high frequency" refers to 1,710 MHz to 2,170 MHz and 2,520 MHz to 2,700 MHz.

The first part of the antenna structure is arranged in parallel to the second part of the antenna structure, and both of the first and second parts of the antenna structure are vertical to the third part of the antenna structure.

The first slit is arranged in parallel to the second slit, the third slit is arranged in parallel to the fourth slit, and both the first slit and the second slit are vertical to the third slit and the fourth slit.

Figure 3:
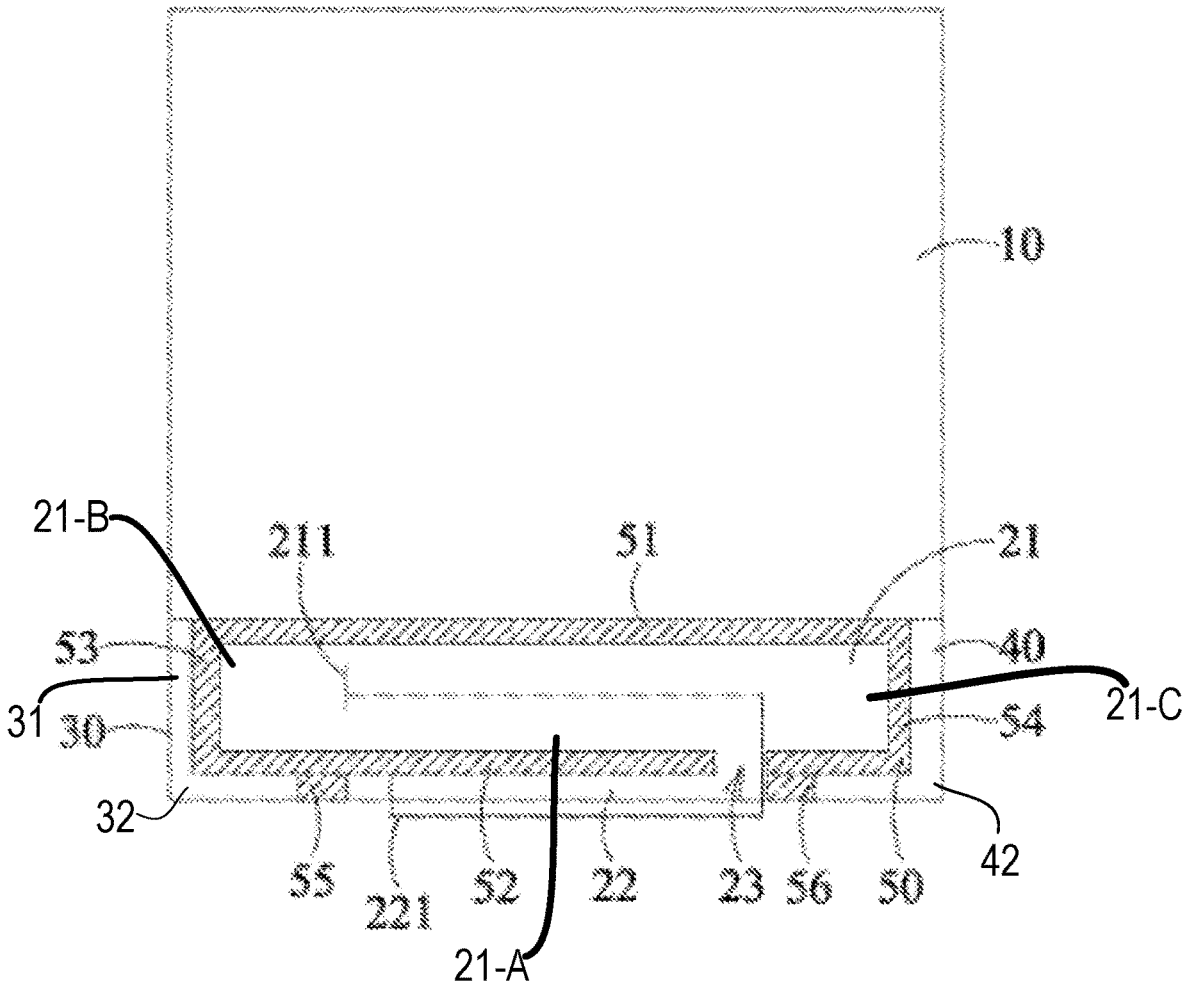
FIG. 3 is a schematic structural diagram of a terminal back cover according to one or more embodiments of this disclosure.

FIG. 3 is a schematic structural diagram of a terminal back cover according to one or more embodiments of this disclosure.

As shown in FIG. 3, the terminal back cover includes: a back cover body 10; an antenna structure, the antenna structure including a first part 21 whose first side is separated from one end of the back cover body 10 by a first slit 51, a second part 22 separated from a second side of the first part 21 by a second slit 52, and a third part 33 for connecting the first part 21 and the second part 22; a first hand-held part 30 extending to the second part 22 of the antenna structure from the back cover body 10 and separated from a third side of the first part 21 of the antenna structure by a third slit 53; and a second hand-held part 40 arranged apart from the first hand-held part 30, extending to the second part 22 of the antenna structure from the back cover body 10 and separated from a fourth side of the first part 21 of the antenna structure by a fourth slit 54, wherein the back cover body 10 and the antenna structure are made of a metal material.

In one or more embodiments of this disclosure, the first part 21 of the antenna structure further includes a first electrical contact part 211 electrically connected to an external circuit; and the second part 22 of the antenna structure further includes a second electrical contact part 221 electrically connected to the external circuit. Thus, the terminal back cover is directly connected to an antenna feed point on a circuit board of a mobile terminal, such as a handset. An electric current path of the antenna structure between the first and second electrical contact parts 211, 221 has a length greater than or equal to one fourth of a wavelength.

In one or more embodiments of this disclosure, the first and second hand-held parts 30, 40 may be made of a metal material, one end of the first hand-held part 30 is separated from one end of the second part 22 to form a fifth slit 55, and one end of the second hand-held part 40 is separated from the other end of the second part 22 to form a sixth slit 56.

When the first and second hand-held parts 30, 40 are made of a metal material, it is necessary to form the fifth slit 55 between the first hand-held part 30 and the second part 22 of the antenna for separating the two parts from each other and to form the sixth slit 56 between the second hand-held part 40 and the second part 22 of the antenna structure for separating the two parts from each other; otherwise, hand-holding will exert an influence on the antenna.

In some embodiments of this disclosure, the first hand-held part 30 is made of a non-metal material, and the second hand-held part 40 is made of a metal material. Meanwhile, the sixth slit 56 is formed between the second hand-held part 40 and the second part 22 of the antenna structure for separating the two parts from each other.

In some embodiments of this disclosure, the second hand-held part 40 is made of a non-metal material, and the first hand-held part 30 is made of a metal material. Meanwhile, the fifth slit 55 is formed between the first hand-held part 30 and the second part 22 of the antenna structure for separating the two parts from each other.

In some embodiments of this disclosure, the first hand-held part 30 and the first part 21 of the antenna structure are separated by the third slit 52; and the second hand-held part 40 includes a third unit and a fourth unit, the third unit being separated from the fourth side of the first part 21 of the antenna structure by the fourth slit 54, and the fourth unit being separated from the second side of the first part 21 by a part of the second slit 52.

In some embodiments of this disclosure, the first hand-held part 30 includes a first unit and a second unit, the first unit being separated from the third side of the first part 21 of the antenna structure by the third slit 53, and the second unit being separated from the second side of the first part 21 by a part of the second slit 52; and the second hand-held part 40 is separated from the first part 21 of the antenna structure by the fourth slit 54.

In one or more embodiments, the terminal back cover may be used as a handset housing whose left and right sides are reserved as the first hand-held part and the second hand-held part. In case an antenna body (i.e., the back cover body) is held in hands, the antenna structures and slits (i.e., the first, second, third, fourth, fifth and sixth slits) which mainly participate in radiation are separated and protected, so that they are not easily held with hands. As such, using an integral metal housing structure as the handset housing will not produce an adverse effect on signals of the handset. The problems with the handset, such as no signal, call drop and the like, may not arise due to the metal housing of the handset. It is also unnecessary to remove metal at the antenna structures from the housing made from metal, such that the handset housing has a consistent appearance, excellent heat conductivity and a relatively long service life.

Figure 4:
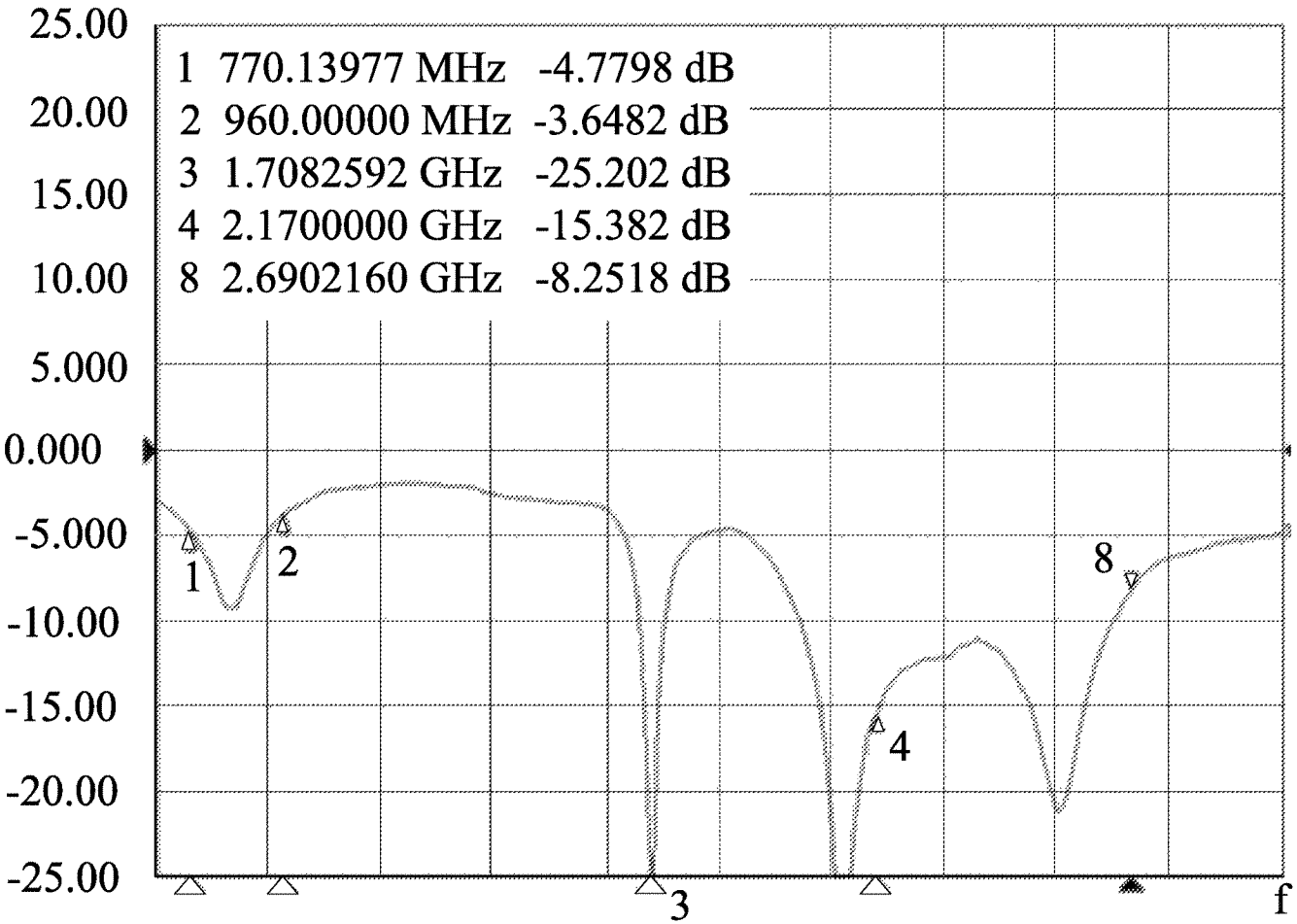
FIG. 4 is a schematic diagram of antenna return loss of a terminal back cover according to one or more embodiments of this disclosure.

FIG. 4 is a schematic diagram of antenna return loss of a terminal back cover according to one or more embodiment of this disclosure.

As shown in FIG. 4, a horizontal coordinate of the antenna return loss drawing represents a frequency d, and a vertical coordinate S11 (unit: dB) is measured using a vector network analyzer. In this embodiment, an operating band S11 of the antenna is required to be less than −5 dB. In FIG. 4, the frequency at point 1 is 770.13977 MHz, and the antenna return loss thereof is −4.7798 dB; the frequency at point 2 is 960 MHz, and the antenna return loss thereof is −3.6482 dB; the frequency at point 3 is 1.7082592 GHz, and the antenna return loss thereof is −25.202 dB; the frequency at point 4 is 2.17 GHz, and the antenna return loss thereof is −15.382 dB; and the frequency at point 8 is 2.6902160 GHz, and the antenna return loss is −8.2518 dB.

Between the antenna structure and the external circuit, there is formed a radiation loop which results in return loss. Specifically, the radiation loop consists of the antenna feed point—the first part of the antenna structure—the second part of the antenna structure—the third part of the antenna structure—the loop grounding part—the external circuit. With the radiation loop formed between the antenna structure and the external circuit, a first low-frequency resonance at a frequency band from 770 MHz to 800 MHz, a first high-frequency resonance at a frequency band from 1,710 MHz to 2,170 MHz, a second high-frequency resonance at a frequency band from 2,170 MHz to 2,300 MHz and a third high-frequency resonance at a frequency band from 2,500 MHz to 2,700 MHz may be generated, and the antenna may operate under these frequency bands.

Figure 5:
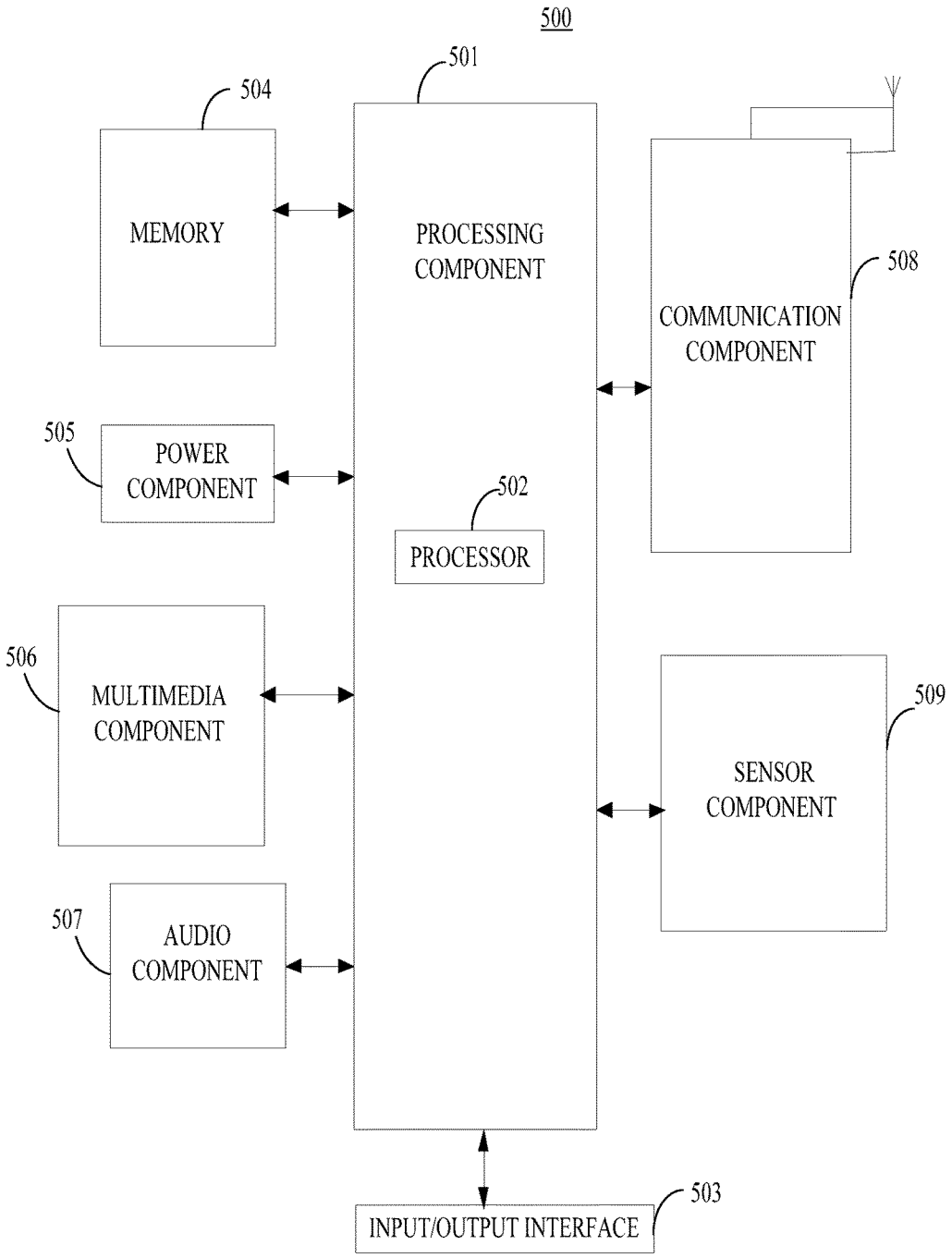
FIG. 5 is a schematic structural diagram of a mobile terminal according to one or more embodiments of this disclosure.

FIG. 5 is a schematic structural diagram of a mobile terminal according to one or more embodiments of this disclosure.

The mobile terminal includes any of the above-described terminal back covers; and a circuit board including an antenna feed point and a loop grounding point.

In one or more embodiments of this disclosure, the mobile terminal further includes a first electrically conductive connector and a second electrically conductive connector, the first electrically conductive connector being configured to electrically connect the antenna feed point and the first electrical contact part of the terminal back cover, the second electrically conductive connector being configured to electrically connect the loop grounding point and the second electrical contact part of the terminal back cover.

In one or more embodiments of this disclosure, the first and second electrically conductive connectors each include at least one of a resilient gasket, a screw, a lumped element and electrically conductive foam. Particularly, when the second electrically conductive connector is grounded as a lumped reactance element, the matching bandwidth of the antenna may be further optimized. If the second electrically conductive connector is grounded as a screw, a resilient gasket or the like, not only the flexibility of adjusting the antenna is introduced, but also the purpose of reinforcement can be achieved.

The first electrically conductive connector and the first electrical contact part are arranged on the first part of the antenna structure, and the second electrically conductive connector and the second electrical contact part are arranged on the second part of the antenna structure, in order to avoid interference of the antenna feed point and the loop grounding point to the radiation of the antenna on one hand and to achieve a favorable effect in terms of appearance beauty of the handset housing on the other hand.

In one or more embodiments of this disclosure, the mobile terminal further includes a radio frequency element. The antenna feed point is arranged on the radio frequency element, and a wireless signal sent from the radio frequency element is coupled to the terminal back cover from the antenna feed point through the first electrically conductive connector and is then sent out.

In one or more embodiments of this disclosure, the back cover body of the terminal back cover can form an all-metal housing together with the antenna structure and can also serve as an antenna of the mobile terminal.

During assembly, the first electrical contact part of the terminal back cover is electrically connected to a radio frequency element, such as a radio frequency chip, within the handset, specifically via a matching network. When the radio frequency chip works, regular electric currents can be excited at two sides of the antenna structure, and flow of the regular electric currents can result in effective radiation.

The metal material for the terminal back cover according to the embodiments of this disclosure may be copper, so that the handset housing is an all-metal copper housing. However, this disclosure is limited thereto, and other suitable metal materials may also be applicable.

As shown in FIG. 5, the mobile terminal 500 includes a processor 502 and a memory 504 storing instructions executable by the processor 502.

For example, the mobile terminal 500 may be a smart phone, a computer, a digital broadcast terminal, a messaging device, a gaming console, a tablet, a medical device, exercise equipment, a personal digital assistant or the like.

Referring to FIG. 5, the mobile terminal 500 may include one or more of the following components: a processing component 501, a memory 504, a power component 505, a multimedia component 506, an audio component 507, an input/output (I/O) interface 503, a sensor component 509, and a communication component 508.

The processing component 501 typically controls overall operations of the mobile terminal 500, such as the operations associated with display, telephone calls, data communications, camera operations, and recording operations. The processing component 501 may include one or more processors 502 to execute instructions to perform all or part of the steps in the above described methods. Moreover, the processing component 501 may include one or more modules which facilitate the interaction between the processing component 501 and other components. For instance, the processing component 501 may include a multimedia module to facilitate the interaction between the multimedia component 506 and the processing component 501.

The memory 504 is configured to store various types of data to support the operation of the mobile terminal 500. Examples of such data include instructions for any applications or methods operated on the mobile terminal 500, contact data, phonebook data, messages, pictures, video, etc. The memory 504 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 505 provides power to various components of the mobile terminal 500. The power component 505 may include a power management system, one or more power sources, and any other components associated with the generation, management, and distribution of power in the mobile terminal 500.

The multimedia component 506 includes a screen providing an output interface between the mobile terminal 500 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 1808 includes a front camera and/or a rear camera. The front camera and the rear camera may receive an external multimedia datum while the mobile terminal 500 is in an operation mode, such as a photographing mode or a video mode. Each of the front camera and the rear camera may be a fixed optical lens system or have focus and optical zoom capability.

The audio component 507 is configured to output and/or input audio signals. For example, the audio component 507 includes a microphone ("MIC") configured to receive an external audio signal when the mobile terminal 500 is in an operation mode, such as a call mode, a recording mode, and a voice recognition mode. The received audio signal may be further stored in the memory 504 or transmitted via the communication component 508. In some embodiments, the audio component 507 further includes a speaker to output audio signals.

The I/O interface 503 provides an interface between the processing component 501 and peripheral interface modules, such as a keyboard, a click wheel, buttons, and the like. The buttons may include, but are not limited to, a home button, a volume button, a starting button, and a locking button.

The sensor component 509 includes one or more sensors to provide status assessments of various aspects of the mobile terminal 500. For instance, the sensor component 509 may detect an open/closed status of the mobile terminal 500, relative positioning of components, e.g., the display and the keypad, of the mobile terminal 500, a change in position of the mobile terminal 500 or a component of the mobile terminal 500, a presence or absence of user contact with the mobile terminal 500, an orientation or an acceleration/deceleration of the mobile terminal 500, and a change in temperature of the mobile terminal 500. The sensor component 509 may include a proximity sensor configured to detect the presence of nearby objects without any physical contact. The sensor component 509 may also include a light sensor, such as a CMOS or CCD image sensor, for use in imaging applications. In some embodiments, the sensor component 509 may also include an accelerometer sensor, a gyroscope sensor, a magnetic sensor, a pressure sensor, or a temperature sensor.

The communication component 508 is configured to facilitate communication, wired or wirelessly, between the mobile terminal 500 and other devices. The mobile terminal 500 can access a wireless network based on a communication standard, such as WiFi, 2G, or 3G, or a combination thereof. In one embodiment, the communication component 508 receives a broadcast signal or broadcast associated information from an external broadcast management system via a broadcast channel. In one embodiment, the communication component 508 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In some embodiments, the mobile terminal 500 may be implemented with one or more circuitries, which include application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components. The mobile terminal 500 may use the circuitries in combination with the other hardware or software components for performing the above described methods. Each module, sub-module, unit, or sub-unit in the disclosure may be implemented at least partially using the one or more circuitries.

In an embodiment, there is also provided a non-transitory computer readable storage medium including instructions, such as included in the memory 504, executable by the processor 502 in the mobile terminal 500, for performing the above-described methods. For example, the non-transitory computer-readable storage medium may be a ROM, a RAM, a CD-ROM, a magnetic tape, a floppy disc, an optical data storage device, and the like.

Reference can be made to the above-described embodiments of the disclosure for other details of this embodiment of the disclosure, which will not be described here redundantly.

With the terminal back cover and the mobile terminal including the same according to this disclosure, when the radio frequency element works, radiation from the antenna of an all-metal housing terminal can be accomplished, and normal use of the handset will not be affected. Regular electric currents can be excited at two sides of the antenna structure, and flow of regular electric currents can result in effective radiation. Therefore, by adjusting the length of the electric current path of the antenna structure, the resonance point of the antenna can be adjusted. Thus, the transmission and reception effects of the antenna are favorable, and the manufacturing cost of the antenna is low. In addition, with the terminal back cover of this disclosure, the housing of the handset is of all metal, so a glossy metal texture is presented to the user of the handset, thereby improving the appearance beauty of the handset.

The terminology used in the present disclosure is for the purpose of describing exemplary embodiments only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference throughout this specification to "one embodiment," "an embodiment," "exemplary embodiment," or the like in the singular or plural means that one or more particular features, structures, or characteristics described in connection with an embodiment is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may be combined in any suitable manner.

Other embodiments of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the disclosure being indicated by the following claims.

The above has specifically shown and described the embodiments of this disclosure. It will be appreciated that the present disclosure is not limited to the exact construction or configuration that has been described above, and this disclosure intends to cover various modifications and equivalent configurations within the spirit and scope of the appended claims.

What is claimed is:

1. A terminal back cover, comprising:

a back cover body:

an antenna structure, including a first part whose first side is separated from one end of the back cover body by a first slit, a second part separated from a second side of the first part by a second slit, and a third part for connecting the first and second parts;

a first hand-held part extending to the second part of the antenna structure from the back cover body and separated from a third side of the first part of the antenna structure by a third slit; and a second hand-held part arranged apart from the first hand-held part, the second hand-held part extending to the second part of the antenna structure from the back cover body and separated from a fourth side of the first part of the antenna structure by a fourth slit, wherein the back cover body and the antenna structure are made of a metal material;

wherein the first hand-held part is separated from the second part by a fifth slit that extends in a parallel direction of the first hand-held part, and the second hand-held part is separated from the second part by a sixth slit that extends parallelly to the fifth slit and the fifth slit is perpendicular to the first slit.

2. The terminal back cover of claim 1, wherein the first and second hand-held parts are electrically isolated from the antenna structure.

3. The terminal back cover of claim 1, wherein the first hand-held part comprises a first unit and a second unit, the first unit being separated from the third side of the first part of the antenna structure by the third slit, the second unit being separated from the second side of the first part by a part of the second slit.

4. The terminal back cover of claim 3, wherein the second hand-held part comprises a third unit and a fourth unit, the third unit being separated from the fourth side of the first part of the antenna structure by the fourth slit, the fourth unit being separated from the second side of the first part by another part of the second slit.

5. The terminal back cover of claim 1, wherein the first and second hand-held parts are made of a non-metal material.

6. The terminal back cover of claim 5, wherein the first and second hand-held parts each comprise a spray coating of a metal-like color.

7. The terminal back cover of claim 1, wherein the first and second hand-held parts are made of the metal material.

8. The terminal back cover of claim 1, wherein the first part of the antenna structure comprises a first electrical contact part electrically connected to an external circuit, and the second part of the antenna structure comprises a second electrical contact part electrically connected to the external circuit.

9. The terminal back cover of claim 1, wherein the antenna structure is operable over a frequency band ranging from 770 MHz to 2,700 MHz.

10. The terminal back cover of claim 8, wherein an electric current path of the antenna structure between the first and second electrical contact parts has a length greater than or equal to one fourth of a wavelength corresponding to a wavelength of electromagnetic waves having a frequency component at 770 MHz.

11. The terminal back cover of claim 1, wherein the first, second, third and fourth slits have the same width.

12. The terminal back cover of claim 11, wherein the width is greater than or equal to 1 mm.

13. The terminal back cover of claim 11, wherein the back cover body and the antenna structure are made of the same metal material.

14. The terminal back cover of claim 1, wherein the first, second, third and fourth slits are filled with an insulating material, the insulating material connecting the back cover body and the first part, the first part and the second part, the first hand-held part and the first part, and the second hand-held part and the first part, respectively.

15. The terminal back cover of claim 14, wherein the insulating material is bonded with the back cover body, the antenna structure, the first hand-held part and the second hand-held part using a nanometer injection molding process.

16. The terminal back cover of claim 1, wherein the antenna structure is positioned below the back cover body.

17. A mobile terminal, comprising:

a circuit board comprising an antenna feed point and a loop grounding point; and a terminal back cover comprising:

a back cover body:

an antenna structure, including a first part whose first side is separated from one end of the back cover body by a first slit, a second part separated from a second side of the first part by a second slit, and a third part for connecting the first and second parts;

a first hand-held part extending to the second part of the antenna structure from the back cover body and separated from a third side of the first part of the antenna structure by a third slit; and a second hand-held part arranged apart from the first hand-held part, the second hand-held part extending to the second part of the antenna structure from the back cover body and separated from a fourth side of the first part of the antenna structure by a fourth slit, wherein the back cover body and the antenna structure are made of a metal material;

wherein the first hand-held part is separated from the second part by a fifth slit that extends in a parallel direction of the first hand-held part, and the second hand-held part is separated from the second part by a sixth slit that extends parallelly to the fifth slit and the fifth slit is perpendicular to the first slit.

18. The mobile terminal of claim 17, further comprising a first electrically conductive connector and a second electrically conductive connector, the first electrically conductive connector being configured to electrically connect the antenna feed point and a first electrical contact part of the terminal back cover, the second electrically conductive connector being configured to electrically connect the loop grounding point and a second electrical contact part of the terminal back cover.

19. The mobile terminal of claim 18, wherein the first and second electrically conductive connectors each include at least one of a resilient gasket, a screw, a lumped element and electrically conductive foam.

20. The mobile terminal of claim 18, further comprising a radio frequency element, wherein the antenna feed point is arranged on the radio frequency element, and the antenna feed point is configured to couple the terminal back cover with a wireless signal sent from the radio frequency element through the first electrically conductive connector.

* * * * *